United States Patent [19]

Stevens

[11] 4,069,801

[45] Jan. 24, 1978

[54] ELECTRONIC IGNITION SYSTEM

[76] Inventor: Carlile R. Stevens, 468 El Rio Road, Danville, Calif. 94526

[21] Appl. No.: 658,516

[22] Filed: Feb. 17, 1976

[51] Int. Cl.[2] ..... F02P 3/06

[52] U.S. Cl. ..... 123/148 DS; 123/148 CB

[58] Field of Search ..... 123/148 CC, 148 CB, 123/148 E, 148 PS; 315/209 T

[56] References Cited

U.S. PATENT DOCUMENTS

| | | | |
|---|---|---|---|
| 1,172,698 | 2/1916 | Flynn et al. | 123/148 DS |
| 3,168,891 | 2/1965 | Cook | 123/148 DS |
| 3,596,646 | 8/1971 | Weiss | 123/148 CB |
| 3,651,341 | 3/1972 | Shawo | 315/209 T |
| 3,722,489 | 3/1973 | Howard | 123/148 CB |

OTHER PUBLICATIONS

Guidebook of Electronic Circuits, J. Markus, McGraw-Hill Book Co. (1974) pp. 78–80.

*Primary Examiner*—Verlin R. Pendegrass
*Assistant Examiner*—S. A. Cangialosi
*Attorney, Agent, or Firm*—Roger A. Marrs

[57] ABSTRACT

An electronic ignition system for an engine is connected in place of the conventional ignition system by a transfer relay that is energized when the ignition switch is closed. An energy storage capacitor is charged by the rectified output of an inverter that is driven by an oscillator and a phase splitter. Upon opening of the ignition system points, an SCR is triggered on to discharge the capacitor across the ignition coil primary. In this manner, the sparking voltage is produced without having high current switched by the points.

The electronic ignition also includes (a) a voltage doubler to insure adequate charging of the energy storage capacitor, and hence optimum spark voltage, during cranking of the engine; (b) a point cleaning circuit; (c) a point bounce eliminator circuit; (d) synchronizer means for disabling the inverter during discharge of the energy storage capacitor; (e) a shut down circuit to insure engine turn-off when the ignition switch is turned off; (f) a proper operation indicator lamp; and (g) automatic switchover to convention ignition operation in the event of electronic ignition failure.

13 Claims, 4 Drawing Figures

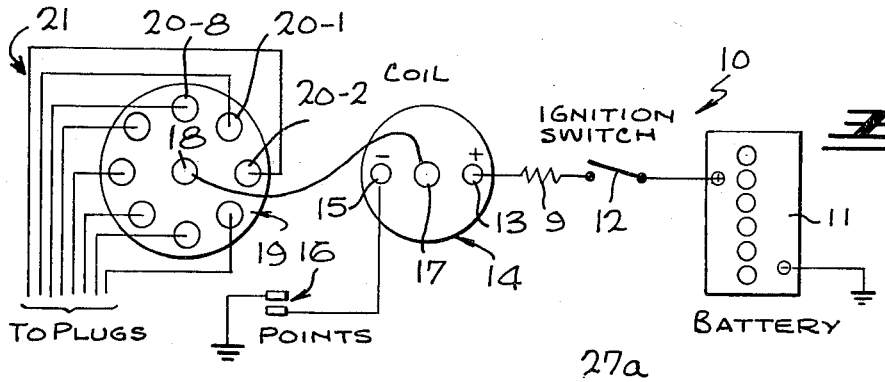
Fig. 1
PRIOR ART
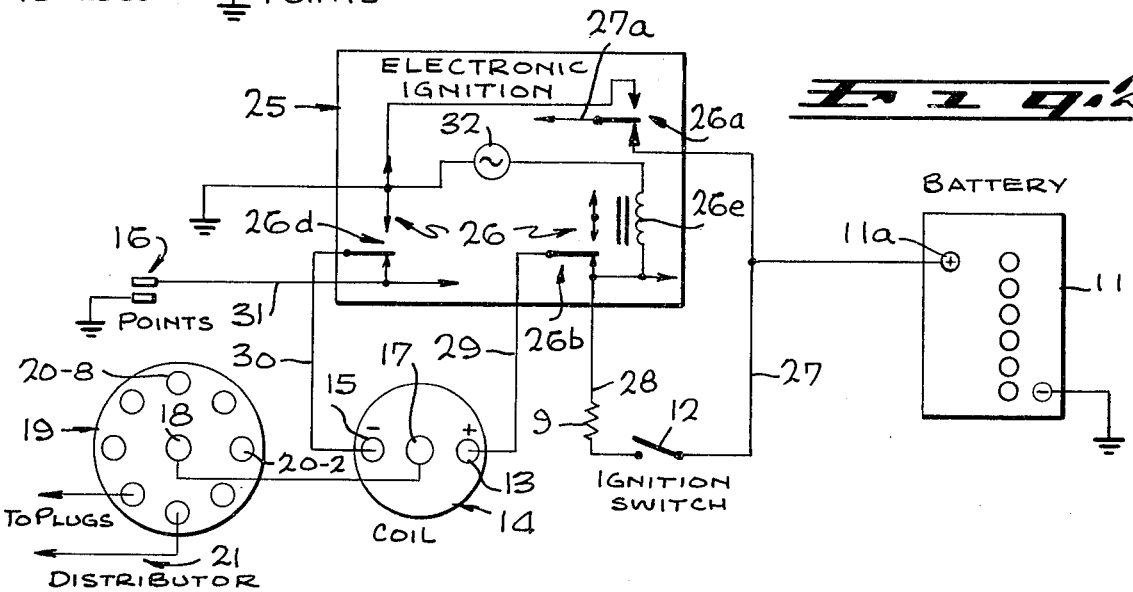
Fig. 2
Fig. 3
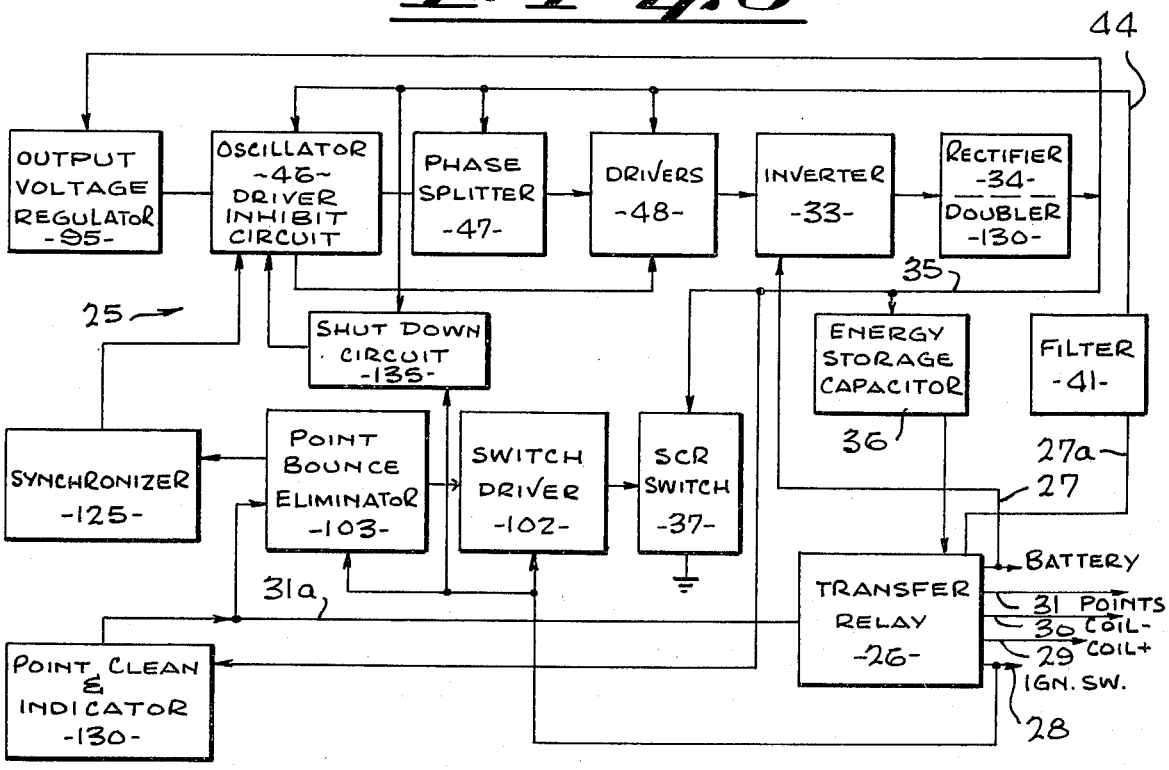

ELECTRONIC IGNITION SYSTEM

BACKGROUND OF THE INVENTION

1. Field of the Invention

The present invention relates to an electronic ignition system for an engine, and more particularly to an electronic ignition that prevents deleterious wearing of the conventional ignition breaker-points while utilizing these points to actuate spark generation.

2. Description of the Prior Art

In a conventional ignition system for an automotive or marine engine, high current from the battery is intermittently switched to the primary of the ignition coil by closure of a set of breaker points normally mounted in the distributor. As the breaker points open, the collapsing magnetic field in the ignition coil primary induces a high voltage in the secondary. This voltage is distributed to the engine plugs by the distributor and used to create the spark that ignites the fuel mixture. Although this system has been employed successfully for many years, it suffers the inherent shortcoming that the points gradually are worn away as a result of the high-current arcing. Such arcing causes metal transfer across the points, oxidation and erosion. Point lifetime is reduced, and there is a slight but continuous change in ignition timing over the life of the points. Eventually, this causes misfiring.

Electronic ignition systems offer the advantage of eliminating such problems associated with point wear. In prior art electronic ignition systems, the points often were eliminated completely, and some alternative timing device, physically connected to the engine or distributor, was used to actuate the ignition system. For example, optical or magnetic switching devices have been used in place of the cam and breaker points. In a typical device of this type, a toothed-wheel called a "reluctor" is attached to the distributor shaft in the same position as the cam in a breaker-point system. A permanent magnet and a coil are mounted in spaced relationship, so that the teeth of the reluctor will pass between them as the distributor shaft rotates. Each time one of the reluctor teeth passes between the magnet and the coil, the magnetic field is changed so as to alter the induced voltage in the coil. This voltage then is used to trigger the electronic ignition.

While such an approach eliminates the point wear problem entirely, it has the disadvantage that it requires total modification of the engine. In other words, such a system cannot easily be added on to an existing engine.

In contrast, it is an object of the present invention to provide an electronic ignition that can easily be added to an existing engine, and which employs the existing points as a timing control means. By eliminating the high currents normally switched by the points, point wear is substantially eliminated. Point lifetime is increased immensely, with a concomitant elimination of the misfiring and improper timing problems associated with breaker point wear.

Other objects of the present invention include (a) voltage regulation to insure consistant spark energy; (b) provision for maintaining the same spark level despite changes in battery output, such as the reduced voltage level during engine cranking; (c) point bounce elimination circuitry to insure that false firing will not occur as a result of point contact bounce; (d) means for automatically cleaning the points; and (e) automatic switchover to conventional ignition operation in the event of electronic ignition failure.

BRIEF DESCRIPTION OF THE INVENTION

These and other objectives are achieved in an electronic ignition that is installed in series with the normal connections between the engine ignition switch, points and ignition coil primary. A transfer relay automatically connects the electronic ignition when energized by closure of the ignition switch. In the unlikely event of electronic ignition failure, the relay becomes de-energized, thereby automatically switching engine operation back to the conventional ignition mode.

In the electronic ignition, an energy storage capacitor is charged while the points are closed. The charging circuit includes an oscillator which toggles a phase splitter that in turn drives an inverter. The inverter output is rectified and supplied to the energy storage capacitor. When the points open, a silicon controlled rectifier (SCR) switch is triggered on to connect the capacitor directly across the ignition coil primary. The capacitor discharges, thereby inducing a high voltage sparking signal at the ignition coil secondary.

A voltage regulator is used to insure that the energy storage capacitor is charged to a constant value during each charging cycle. As a result, very consistent sparking energy is achieved. Moreover, the voltage applied by the energy storage capacitor across the primary of the ignition coil may be higher than that normally supplied by the conventional ignition. As a result, a higher sparking energy may be obtained. Furthermore, a voltage doubler circuit is also connected to the inverter output so as to supply adequate voltage to the energy storage capacitor during cranking or other times when the battery voltage is low. Thus optimum spark voltage can be obtained over a very wide range of battery output voltage.

The points in the engine ignition system switch only a low current, and hence do not suffer the point contact wear typical of conventional operation. A point cleaning circuit is provided to apply an arcing voltage across the points when the engine is being cranked. This arcing effectively removes accumulated moisture and dirt from the points.

BRIEF DESCRIPTION OF THE DRAWINGS

A detailed description of the invention will be made with reference to the accompanying drawings wherein like numerals designate corresponding elements in the several figures.

FIG. 1 is a simplified wiring diagram of a conventional engine ignition system.

FIG. 2 is a simplified wiring diagram showing the manner in which the inventive electronic ignition is connected into the system of FIG. 1.

FIG. 3 is an electrical block diagram of the inventive electronic ignition.

DESCRIPTION OF THE PREFERRED EMBODIMENT

Figure 4:
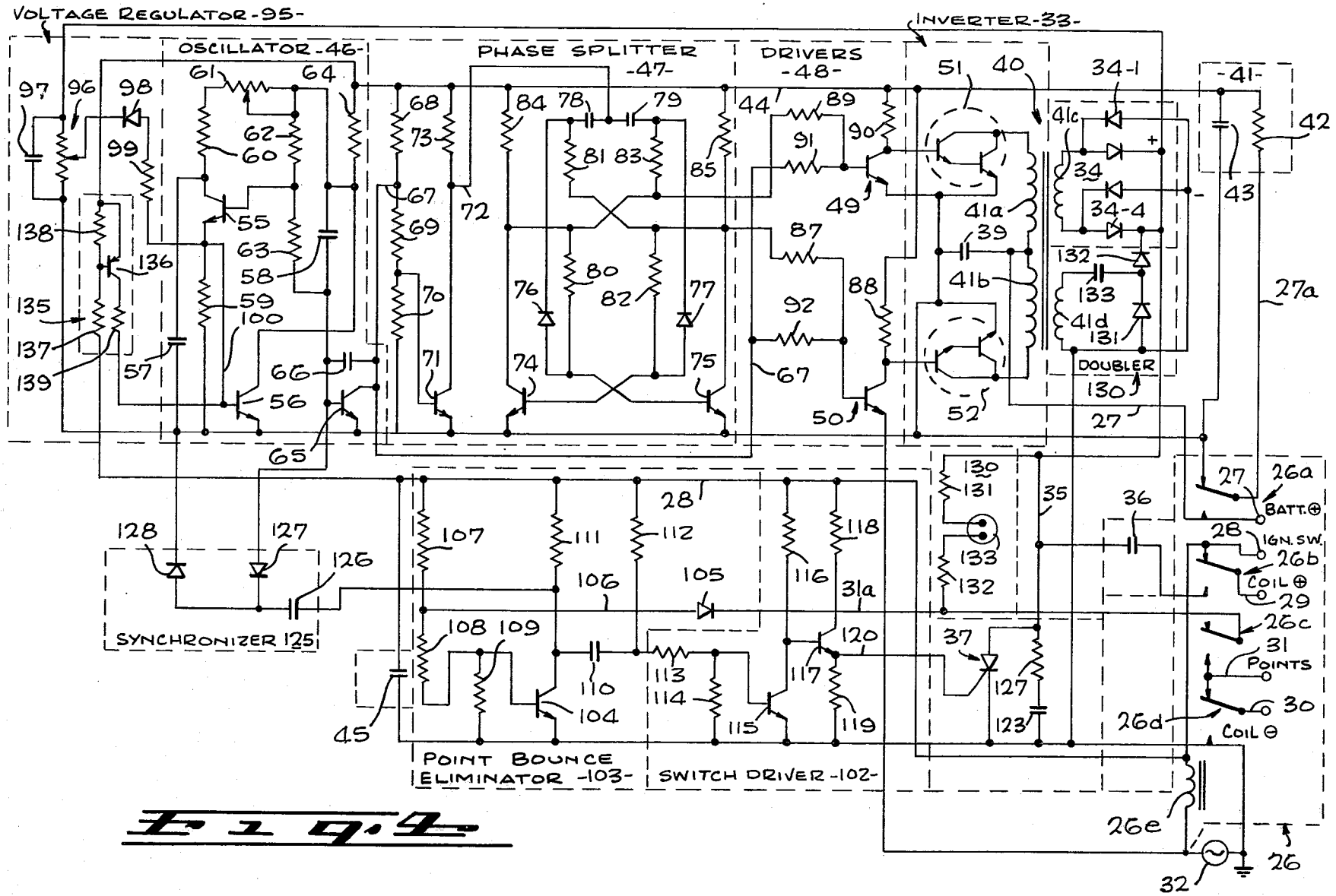
FIG. 4 is an electrical schematic diagram of the electronic ignition of FIG. 3.

The following description is of the best presently contemplated mode of carrying out the invention. This description is not to be taken in a limiting sense, but is made merely for the purpose of illustrating the general principles of the invention since the scope of the invention best is defined by the appended claims.

In the prior art engine ignition system 10 of FIG. 1, power from a battery 11 is connected via an ignition switch 12 via ballast resistor 9 to the positive (+) terminal 13 of an ignition coil 14. The negative (−) terminal 15 of the ignition coil 14 is connected to ground via a set of points 16. The high voltage output terminal 17 of the ignition coil 14 is connected to the common terminal 18 of the engine distributor 19. The various other distributor terminals 20-1 through 20-8 are connected via a set of wires 21 to the engine plugs (not shown).

When the ignition switch 12 is closed, high current from the battery 11 is applied to the ignition coil 14 primary each time the points 16 close. This current is limited only by the value of ballast resistor 9. As the points 16 open, the collapsing magnetic field of the primary winding induces a high voltage across the ignition coil secondary. This voltage is supplied from the terminal 17 to the distributor 19 where it is distributed to the plugs in a known manner. As described above, the high current switched by the points 16 results in deterioration of the points 16 due to metal transfer caused by arcing, oxidation and erosion. Eventually, this results in erroneous engine timing and misfiring.

Such dilatarious effects are eliminated by using the inventive electronic ignition 25 which advantageously is installed as shown in FIG. 2. Included in the ignition 25 is a transfer relay 26 which is FIGS. 2 and 4 is shown in the de-energized position. In this state, wiring connections identical to those of FIG. 1 are completed via the relay switch sections **26*b* and 26*d*. Thus the battery positive (+) terminal 11*a* is connected via a line 27, the ignition switch 12, ballast resistor 9, a line 28, the normally closed relay contacts 26*b* and a line 29 to the ignition coil positive terminal 13. The coil negative terminal 15 is connected via a line 30, the normally closed relay contact 26*d* and a line 31 to the points 16. With the relay so de-energized, the ignition system will operate in the conventional manner described above in connection with FIG. 1. This will occur e.g., if a fuse 32 in the ignition 25 should blow out, removing current from the relay coil 26*e***.

Under normal operating conditions, when the ignition switch 12 is closed, current flows from the battery 11 through the relay coil **26*e* so as to energize the relay 26. As a result, operation is transferred to the electronic ignition 25. As described below in connection with FIGS. 3 and 4, high current to the ignition coil 14 primary no longer is supplied through the points 16. Instead, the battery 11 is used to power an inverter 33 (FIG. 3) the output of which is rectified by a bridge rectifier 34 and supplied via a line 35 to charge an energy storage capacitor 36. Each time the points 16 open, a silicon controlled rectifier (SCR) switch 37 is triggered on. This causes the energy storage capacitor 36 to be discharged directly across the primary of the ignition coil 14. As a result, a high voltage is induced across the ignition coil secondary 17, just as though the coil 14 had been energized in the conventional manner of FIG. 1. Unlike the FIG. 1 system however, high current is not switched through the points 16**. As a result, there is insignificant point contact deterioration, and the engine timing remains constant over long periods of time.

Referring to FIGS. 3 and 4, power directly from the battery 11 is supplied via line 27 and a filter capacitor 39 to the center tap primary of a transformer 40 in the inverter 33. When the transfer relay 26 is energized, battery power also is supplied via the relay contact **26*a* and a line 27*a* to a filter 41 consisting of a resistor 42 and a capacitor 43. Filtered dc voltage thence is supplied via a line 44 to the circuits which drive the inverter 33. This prevents the inverter from operating when relay 26 is open and ignition switch 12 is off. Positive voltage supplied via the ignition switch 12 and the line 28 is filtered by a capacitor 45 and supplied to the circuitry which triggers the SCR switch 37. In this manner, dc isolation is achieved between the trigger circuitry and those circuits which are used to charge the energy storage capacitor 36. The inverter 33 must be connected to battery 11 since ballast resistor 9 would restrict current to inverter 33** at high engine speeds.

The charging circuits include an oscillator 46 that is used to trigger a phase splitter 47 which consists of a bi-stable multivibrator. The phase splitter 47 is connected to a driver circuit 48 consisting of a pair of driver transistors 49, 50. When the phase splitter 47 is in one state, the transistor 49 is turned on and the transistor 50 is off. Conversely, when the phase splitter 47 is triggered to the alternate state, the transistor 49 is off and the transistor 50 is on. In turn, the transistors 49 and 50 respectively drive a pair of Darlington switching circuits 51, 52 which respectively connect battery power across one or the other of the transformer 40 primary windings **41*a* and 41*b*. In this manner, an alternating voltage is produced across the transformer 40 at a frequency established by the oscillator 46**.

The rectifier 34 is a bridge circuit consisting of four diodes 34-1 through 34-4 connected across a secondary winding **41*c* of the transformer 40. The bridge 34 rectifies the transformer 40 output and provides a dc signal on the line 35 to charge the energy storage capacitor 36. The oscillator 46 employs a pair of transistors 55, 56, a pair of capacitors 57, 58 and a set of resistors 59 through 65 connected as a relaxation-type oscillator. The variable resistor 61 permits adjustment of the oscillator 46 frequency to optimize the charging rate of the capacitor 36**.

In the relaxation oscillator 46, the capacitor 57 is charged while the transistors 55, 56 both are off. Once the capacitor 57 reaches a sufficiently high voltage, the transistor 55 is biased on, which in turn biases on the transistor 56 and causes the capacitor 57 to discharge through the transistor 55 and the transistor 56. During the time that the capacitor 57 is discharging, approximately five percent of the cycle time, a transistor 65 shunted by a capacitor 66 is held off. This produces a high signal on a line 67 that is used to toggle the phase splitter 47.

To this end, the signal on the line 67 is supplied via a voltage divider consisting of the resistors 68–70 to the base of a transistor 71. This produces a toggle signal on a line 72 from the junction of the transistor 71 and its collector resistor 73.

The phase splitter 47 consists of a bistable multivibrator incorporating a pair of transistors 74, 75, a pair of diodes 76, 77, a pair of capacitors 78, 79, and a set of resistors 80–85, all conventionally connected. The toggle signal on the line 72 is connected to the junction of the capacitor 78 and 79. When the phase splitter 47 is in one state with the transistor 74 on and the transistor 75 off, the high signal is supplied via a resistor 87 to turn on the driver transistor 50. As a result, current is drawn through the collector resistor 88 and a low voltage is supplied to the Darlington 52 to keep that unit off. Concurrently, since the transistor 74 is on, a relatively low voltage is supplied via a resistor 89 to the transistor 49. That transistor remains off, so that a high voltage is supplied via the collector resistor 90 to turn on the Darlington 51.

At the next occurrence of the high signal on the line 67, the toggle signal supplied on the line 72 causes the phase splitter 47 to switch to its alternate state in which the transistor 74 is off and the transistor 75 is on. The resultant signals supplied via the resistors 87 and 89 are appropriate for turning on the transistor 49 and turning off the transistor 50. However, these transistors typically can be turned on faster than they can be turned off. As a result, it is possible that when the phase splitter 47 changes state, one of the Darlingtons 51, 52 may be turned on before the other one is completely off. This would result in the undesirable simultaneous on state of both Darlingtons 51, 52 with concomitant power overloading.

To prevent this, each time the oscillator 46 output signal biases off the transistor 65, the high signal on the line 67 is supplied via a pair of resistors 91, 92 to both transistors 49, 50. This high signal forces both driver transistors 49, 50 on, thereby inhibiting or turning off both of the Darlington circuits 51, 52 for a short time period after toggling of the phase splitter 47. As soon as the signal on the line 67 goes low, the appropriate driver transistor 49 or 50 and Darlington 51 or 52 are turned on. This insures that each Darlington 51, 52 is fully off before the other is turned on. Thus the transistor 65 functions as a driver inhibit circuit.

The driver inhibit function of the transistor 65 also is used in conjunction with regulation of the voltage to which the capacitor 35 is charged. To obtain a uniform spark regardless of the voltage level from the battery 11, a voltage regulator 95 (FIGS. 3 and 4) is used to insure that the capacitor 36 always is charged to the same level. Thus each time the points 16 open, a uniform energy pulse is applied to the ignition coil 14, resulting in a constant output pulse level from the coil secondary 17 to the distributor 19.

To this end, the charging voltage supplied via the line 35 to the capacitor 36 also is fed to a potentiometer 96, shunted by a capacitor 97, in the regulator 95. The potentiometer tap is connected via a Zener diode 98 and a resistor 99 to the base 100 of the transistor 56.

The settinhg of the potentiometer 96 establishes the voltage level to which the capacitor 36 will be charged. Advantageously this is about 275 volts. When the capacitor 36 has been charged to this level, the Zener diode 98 will conduct, thereby biasing on the transistor 56. This prevents continued oscillation of the oscillator 46, and hold the transistor 65 off. As a result, a high driver inhibit signal is provided on the line 67 which turns on both transistors 49 and 50, and hence turns off both of the Darlington circuits 51, 52 in the inverter 33. No additional output is supplied from the rectifier 34, and the capacitor 36 remains at the desired voltage level until it is discharged across the ignition coil 14 the next time that the points 16 open. Uniform spark voltage thus is obtained. Discharge of the capacitor 36 is controlled by the SCR 37 which is triggered on by a switch driver circuit 102 when the points 16 open. A point bounce eliminator circuit 103 prevents false triggering of the SCR 37 should the points bounce or make multiple contact upon opening or closure.

The bounce eliminator circuit 103 includes a transistor 104 which is biased off when the points 16 are closed. To this end, the line 31 from the points 16 is connected via the relay contact **26*c*, a line 31*a*, a diode 105 and a line 106 to the junction of a pair of resistors 107, 108 that are connected between the positive voltage line 28 and the base of the transistor 104. That base also is connected via a resistor 109** to ground.

When the points 16 are closed, a current path is provided through the resistor 107, the diode 105 and the points 16 to ground. As a result, a line 106 is held near ground potential and the transistor 104 is biased off. This permits a capacitor 110 to be charged via a current path including the transistor 104, collector resistor 111 and a network of resistors 112–114. The voltage at the junction of the resistors 113 and 114 is sufficient to bias on a transistor 115 which has a collector resistor 116. The resultant low collector voltage biases off a transistor 117 connected as an emitter follower with a collector resistor 118 and an emitter resistor 119. As a result, no trigger signal is supplied via the line 120 to the SCR 37.

When the points 16 open, the junction of the resistors 107 and 108 rises in voltage, turning on the transistor 104. The resultant negative-going transient at the collector of the transistor 104 is supplied via the capacitor 110 to turn off momentarily the transistor 115. This causes a concomitant momentary turn-on of the emitter follower 117, producing a trigger signal on the line 120 which turns on the SCR 37. As a result, the energy storage capacitor 36 quickly is discharged via the SCR 37 across the ignition coil 14 primary.

A snubbing circuit consisting of a resistor 122 and a capacitor 123 prevents false triggering of the SCR 37 by noise on the charging line.

When the points 16 close, the transistor 104 is turned off. However, another SCR 37 trigger signal cannot be produced until the capacitor 110 again is charged through the resistor 111. The charging time constant is selected so that if the points should bounce and quickly reopen, the capacitor 110 will not be sufficiently charged to pass to the transistor 115 the negative going transient associated with the point bounce opening. As a result, the transistor 115 will not go off, and no erroneous trigger signal will be produced by the emitter follower 117. False contact bounce triggering of the SCR 37 is prevented.

When the SCR 37 is triggered on to discharge the energy storage capacitor 36 across the ignition coil 14, the SCR 37 also presents a direct short circuit across the output of the inverter 33. That is, the SCR 37 directly shorts the rectifier 34 positive output line 35 to ground. To keep this short circuit condition from damaging the inverter 33, operation of the inverter 33 is inhibited each time that the points 16 open to trigger the SCR 37. This is accomplished by means of a synchronizer circuit 125. When the points 16 open, the negative going transient at the collector of the transistor 104 is coupled via a capacitor 126 and a diode 127 to the base of the transistor 65. This causes the transistor 65 to go off, thereby providing the high signal on the line 67 that forces on both of the driver transistors 49, 50 and forces off the Darlington circuits 51, 52. In this manner, operation of the inverter 33 is inhibited when the points 16 open and the SCR 37 is triggered on. The inverter 33 remains turned off for a brief time duration during which the capaictor 126 is charged by current supplied in the path including the resistors 62–64 and a diode 127. Discharge of capacitor 126 is achieved when points 16 close through the path provided by resistor 111 and diode 128.

During cranking of the engine, the battery 11 voltage may drop as low as 8 volts. As a result, the output from the rectifier 34 may be insufficient to charge the capacitor 36 to the desired voltage. Under these conditions, a voltage doubler circuit 130 connected to the inverter 33 transformer secondary winding 41*d* is used to provide an adequate charging voltage to the capacitor 36. The doubler 130 consists of a pair of diodes 131, 132 and a capacitor 133 connected in a conventional doubler arrangement with the output connected to the line 35. When the engine is running normally, the doubler 130 contributes relatively little to the charging of the capacitor 36. However, during cranking or at other times when the battery 11 voltage is low, the doubler 130 provides adequate voltage to charge the capacitor 36 up the desired, regulated value. This insures that the optimum spark signal will be produced at the secondary of the ignition coil 14 even during cranking of the engine and allows for transformer 40 to be designed to operate more efficiently at normal battery voltage reducing its size and cost.

When the inventive electronic ignition 25 is employed, arcing of the points 16 is eliminated, thereby substantially reducing the wear on the points. However, such arcing did have the benefit of removing accumulated moisture and dirt from the points. To accomplish this beneficial object, the inventive electronic ignition 25 includes a point cleaning and indicator circuit 130.

The voltage supplied on the line 35 and used to charge the energy storage capacitor 36 is applied to the points 16 via a pair of resistors 131, 132 and an indicator lamp 133. The diode 105 prevents this voltage from reaching the point bounce eliminator circuit 103. During normal engine running operation, insufficient current flows through the circuit 130 to charge the capacitor (not shown) that normally is connected across the points 16 in the engine distributor 19. However, at the slow cranking speeds when the engine is started, this capacitor is charged by the voltage supplied via the circuit 130. As a result, each time the points 16 close, the capacitor discharges causing an arc that burns away accumulated moisture and dirt.

The lamp 133 indicates proper operation of the electronic ignition 25. When the inverter 33 is functioning properly, the lamp 133 will be lit in coincidence with closing of the points 16 and charging of the energy storage capacitor 36.

In many automobiles, a generator or alternator failure lamp, mounted on the dashborad, is connected to the ignition switch 12. If the alternator should fail to produce voltage, current will flow through the lamp and turn it on. When the electronic ignition 25 is employed, sufficient current may flow through this indicator lamp when the ignition switch 12 is turned off so as to hold the relay 26 in the energized state. To insure that the engine is turned off when this occurs, a shutdown circuit 135 is incorporated in the present invention.

The shutdown circuit 135 includes a transistor 136 which is biased off so long as the voltage from the ignition switch 12, provided via the line 28 and a resistor 137, is equal to the battery 11 voltage supplied via the line 44 and a resistor 138. When the ignition switch 12 is turned off, the voltage on the line 28 will drop sufficiently so as to turn on the transistor 136. As a result, a signal is supplied via a resistor 139 to the base of the transistor 56. This turns on the transistor 56, thereby stopping operation of the oscillator 46 and turning off the transistor 65 so as to produce the high signal on the line 67 which inhibits operation of the inverter 33. As a result, the capacitor 36 is no longer charged up, no sparking signal is produced from the ignition coil 14, and the engine stops running. Intending to claim all novel, useful and unobvious features shown or described, the inventor makes the following:

I claim:

1. An electronic ignition system for an engine having an ignition coil and points through which battery power normally is switched to the ignition coil primary, comprising:

circuit transfer means for connecting said battery, said points and said ignition coil primary to said electronic ignition, an energy storage capacitor, charging means, utilizing power from said battery, for charging said capacitor to a level sufficient to excite said ignition coil, switch means, responsive to operation of said points, for discharging said capacitor across said ignition coil primary each time said points are actuated, said discharged energy causing said ignition coil to provide its normal output, so that said ignition coil is operated without switching high battery current to said ignition coil primary via said points, said circuit transfer means comprises a relay actuated when the ignition switch of said engine is closed, said relay in the deactuated state connecting said battery to said ignition coil primary via said points for conventional ignition operation, said relay in the actuated state connecting said battery to said charging means, connecting said points to said switch means and connecting said ignition coil to said capacitor and switch means, thereby facilitating electronic ignition operation, said electronic ignition having a fuse in series with the coil of said relay so that in the event of an electronic ignition failure that causes said fuse to blow out, said relay will be deactuated and said engine will operate in the conventional ignition mode.

2. An electronic ignition system according to claim 1 wherein said charging means comprises;

an oscillator, an inverter having a pair of transistor devices that alternately switch power to a transformer, a bistable circuit toggled by said oscillator, a pair of driver transistors each of which is oppositely, alternately turned on and off by said bistable circuit, each driver transistor driving a respective one of said inverter power switching transistor devices, and a driver inhibit circuit, cooperating with said oscillator and said driver transistors, for turning off both of said inverter power switching transistor devices for a brief time period as said bistable circuit is toggled so as to insure that each such transistor device is completely off before the other transistor device is turned on.

3. An electronic ignition system according to claim 2 wherein said charging means further comprises a rectifier connected to a secondary of said inverter transformer, the output of said rectifier being connected to charge said capacitor, and wherein said switch means comprises a controlled rectifier connecting said capacitor across said ignition coil primary, and a trigger circuit for triggering on said controlled rectifier and thereby discharging said capacitor across said ignition coil primary in response to actuation of said points.

4. An electronic ignition system according to claim 3 wherein said trigger circuit triggers on said controlled rectifier in response to opening of said points, and includes a bounce eliminator circuit for preventing erroneous multiple triggering of said controlled rectifier should said points bounce.

5. An electronic ignition system according to claim 4 wherein said trigger circuit comprises;

a first transistor that is switched on when said points open, a second transistor that is switched off in response to turn-on of said first transistor, an emitter follower transistor that is turned on when said second transistor goes off, said trigger signal being obtained from the emitter of said emitter follower transistor, said trigger signal being supplied to the trigger terminal of said controlled rectifier, and wherein said bounce eliminator comprises a first capacitor connected between the output of said first transistor and the input of said second transistor, and a resistor connecting a source of power to said capacitor and to the collector of said transistors, whereby when said first transistor goes on, said second transistor will go off only if said first capacitor has already been charged, whereby bounce openings of said points during the subsequent charging time of said first capacitor will not cause said second transistor again to go off, thereby preventing erroneous "bounce" trigger signals.

6. An electronic ignition system according to claim 3 wherein said rectifier output is directly connected both to said capacitor and to said controlled rectifier, and further comprising a synchronizer circuit, cooperating with said driver inhibit circuit, for inhibiting operation of said inverter when said capacitor is discharged across said ignition coil primary upon actuation of said points.

7. An electronic ignition system according to claim 6 wherein said oscillator is a relaxation oscillator including a capacitor which is discharged during a short portion of the oscillation cycle, wherein said driver inhibit circuit comprises a transistor connected to be turned off when said oscillator capacitor discharges and to produce an inhibit signal when so turned off, said inhibit signal forcing both of said driver transistors into conduction and thereby forcing both of said inverter power switching transistor devices off.

8. An electronic ignition system according to claim 7 wherein said synchronizer circuit provides a signal that turns off the transistor in said driver inhibit circuit for a brief time period in response to actuation of said points.

9. An electronic ignition system according to claim 3 further comprising voltage regulator means, connected to said energy storage capacitor, for inhibiting operation of said charging means when the voltage to which said capacitor has been charged reaches a preselected value.

10. An electronic ignition system according to claim 9 wherein said voltage regulator comprises a potentiometer effectively connected across said energy storage capacitor, and a Zener diode connecting a tap on said potentiometer to said oscillator, whereby when said voltage across said capacitor reaches said preselected value, oscillation of said oscillator is stopped and said driver inhibit circuit inhibits operation of said inverter.

11. An electronic ignition system according to claim 9 further comprising a voltage doubler connected to another secondary of said inverter transformer, the output of said voltage doubler also being connected to said energy storage capacitor and operative to charge said energy storage capacitor during engine cranking when the battery voltage is low.

12. An electronic ignition system according to claim 1 further including a point cleaning circuit comprising a resistor path from the output of said charging means to said points, voltage from said charging means thereby charging up a capacitor across said points during engine cranking, said capacitor discharging across said points to clean them, and a diode connected between said resistor path and said switch means for preventing said charging voltage from reaching said switch means via the connection thereto from said points.

13. An electronic ignition system according to claim 1 further including a shut-down circuit for inhibiting engine operation in the event said transfer relay does not become deactuated when said ignition switch is turned off due to current supplied by an indicator lamp shunting said ignition switch, said shut-down circuit comprising a transistor biased off when the voltage supplied via said ignition switch equals the voltage from said battery, said transistor being biased on after turn-off of said ignition switch when the voltage supplied via said shunting lamp is lower than the voltage from said battery, said biased-on transistor supplying a signal to said charging means to inhibit operation thereof.

* * * * *